US006622530B1

(12) United States Patent
Sümer et al.

(10) Patent No.: US 6,622,530 B1
(45) Date of Patent: Sep. 23, 2003

(54) SUSPENSION MECHANISM FOR CONNECTING THE MOVING TUB ASSEMBLY OF THE WASHING MACHINES WITH HORIZONTAL AXIS TO THE FIXED BODY

(75) Inventors: Tahsin I. Sümer, Istanbul (TR); Umit Altun, Istanbul (TR)

(73) Assignee: Arcelik A.S., Istanbul (TR)

( * ) Notice: Subject to any disclaimer, the term of this patent is extended or adjusted under 35 U.S.C. 154(b) by 0 days.

(21) Appl. No.: 09/720,310

(22) PCT Filed: Feb. 8, 1999

(86) PCT No.: PCT/TR99/00004

§ 371 (c)(1),
(2), (4) Date: Dec. 26, 2000

(87) PCT Pub. No.: WO00/00689

PCT Pub. Date: Jan. 6, 2000

(30) Foreign Application Priority Data

Jun. 26, 1998 (TR) ..... 98/01240

(51) Int. Cl.[7] ..... D06F 37/20

(52) U.S. Cl. ..... 68/23.2; 68/24; 68/58; 68/140

(58) Field of Search ..... 68/23 R, 23.1, 68/23.2, 24, 58, 140

(56) References Cited

U.S. PATENT DOCUMENTS

| | | | | |
|---|---|---|---|---|
| 2,968,174 | A | * | 1/1961 | Bell et al. |
| 3,021,701 | A | * | 2/1962 | Metz |
| 3,100,978 | A | * | 8/1963 | Howlett |
| 3,111,017 | A | * | 11/1963 | Searle |
| 3,197,983 | A | * | 8/1965 | Ilmer |
| 3,273,361 | A | * | 9/1966 | Smith |
| 3,546,904 | A | * | 12/1970 | Zapfel |
| 5,165,260 | A | | 11/1992 | Geiger |

FOREIGN PATENT DOCUMENTS

| | | | |
|---|---|---|---|
| AT | 222611 | * | 8/1962 |
| DE | 206393 | * | 11/1959 |
| DE | 1189468 | * | 3/1965 |
| DE | 1193885 | * | 5/1965 |
| DE | 1201776 | * | 9/1965 |
| DE | 1432784 | * | 4/1969 |
| DE | 1938536 | * | 5/1970 |
| DE | 4103961 | * | 8/1992 |
| FR | 1328506 | * | 4/1963 |
| FR | 1370624 | * | 7/1964 |
| FR | 1418762 | * | 10/1965 |
| FR | 1422355 | * | 11/1965 |
| FR | 1542882 | * | 9/1968 |
| GB | 965564 | * | 7/1964 |
| GB | 1 140 835 | | 1/1969 |
| GB | 1257240 | * | 12/1971 |
| JP | 61-8093 | * | 1/1986 |
| JP | 63-15998 | * | 1/1988 |
| JP | 63-95085 | * | 4/1988 |
| JP | 10-216393 | * | 8/1998 |
| SU | 146260 | * | 1/1961 |

* cited by examiner

*Primary Examiner*—Frankie L. Stinson
(74) *Attorney, Agent, or Firm*—Nixon & Vanderhye

(57) ABSTRACT

The present invention relates to a suspension mechanism in automatic washing machines with horizontal axis, consisting of connecting the moving tub assembly (2) with cabinet (1), using one or more elastic band(s) (6) on one or more plane(s) crossing the tub (2) geometrical axis, (and drum (3) rotary axis) laterally or longitudinally. Some or all of the bands may be connected in a stretched manner so that they could support the weight of the tub assembly or they may be connected loosely so that they will start to operate after some movement of the tub assembly. The resistance and damping parameters for the suspension mechanism are provided by properly dimensioning the bands, and by their reciprocal movements with friction on the tub and/or by their own elasticity.

23 Claims, 10 Drawing Sheets

Figur 8a
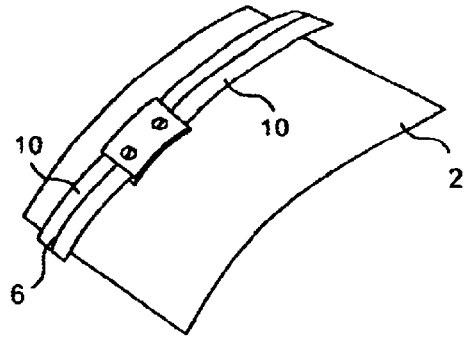
Figure 8b
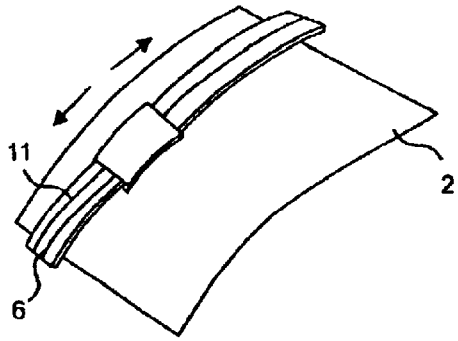
Figure 8c
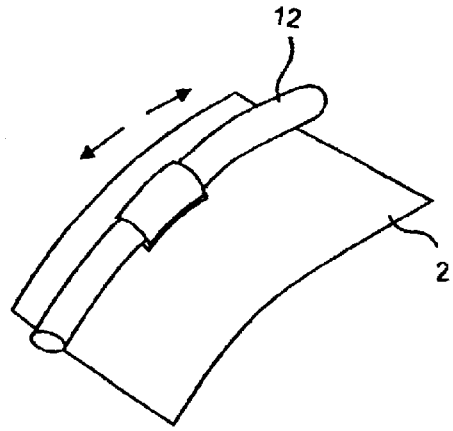
Figure 8d
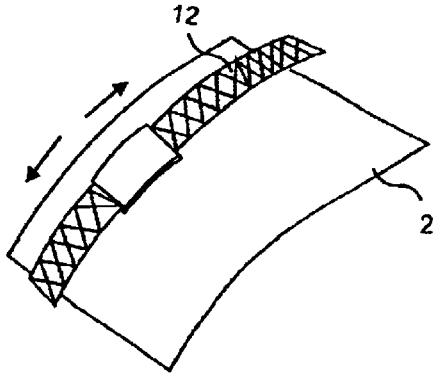

SUSPENSION MECHANISM FOR CONNECTING THE MOVING TUB ASSEMBLY OF THE WASHING MACHINES WITH HORIZONTAL AXIS TO THE FIXED BODY

TECHNICAL FIELD

The present invention relates to a suspension mechanism in automatic washing machines with horizontal axis, loaded from the front or from the top, providing the positioning of the tub (2) and its vibratory movement in the cabinet (1).

Automatic washing machines are electrical appliances wherein the clothes loaded into a cylindirical drum (3) are washed by the agitation/fluctuations created by the rotation of the drum (3). The basic functions of the machine such as water and detergent intake, washing, rinsing, spindrying and water discharge are performed automatically and according to a predetermined program. Washing machines with horizontal axis are characterized in that the rotational axis of the drum (3) wherein the laundry is loaded, is parallel or inclined at an angle smaller than 45° to the ground. There are two major types of automatic washing machines with horizontal axis, with regard to the location of the loading door, namely front-loading and top-loading machines. In the front-loading machines with horizontal axis, the opening axis of the loading door is perpendicular to the axis of the drum (3) rotary axis and it is perpendicular or at some angle to the floor in front of the cabinet (1), depending on whether the drum (3) rotary axis is parallel or at a certain angle to the floor. Whereas in the top-loading horizontal axis machines, the door is on top of the cabinet (1) and its opening axis is parallel to and above the drum (3) rotary axis.

The tub assembly comprising the drum (3) vibrates due to the non-uniform and unbalanced distribution of the laundry in the drum (3) because of such processes as inserting the clothes in the water and taking them out, and dropping them down from certain heights with the rotary motion of the drum (3) during the washing cycle and the laundry taking a lumpy form during rinsing and spinning operations. The suspension mechanism is an arrangement consisting of such components as springs (4), dampers (5) and the like, to be used for the purpose of damping (suppressing) these vibrations and transferring them to the cabinet (1) of the machine so that the user will not be disturbed.

STATE OF ART RELATED TO THE INVENTION

The components making up the automatic washing machines with horizontal axis can be classified in general terms as: a cabinet (1), moving tub (2) assembly, suspension mechanism and water connection parts.

The cabinet (1) is provided with the detergent dispenser, control panel, laundry loading door, pump, water inlet and outlet hoses. As mentioned above, the laundry loading door is in front of the cabinet (1) in front-loading machines and is on top of the cabinet (1) in top-loading machines.

The moving tub assembly consists of; a drum (2), counter weights fixed on the drum (2), a roller bearing at the rear surface of the tub (2), a cylindrical shaft passing through the said roller bearing and making rotating movement, a flange fixed to this shaft, a geometrically symmetric drum (3) connected to the shaft by means of the said flange, a heater placed between the outer surface of the drum (3) and the inner surface of the tub (2), an electrical motor mounted below or behind the tub (2) or in the roller bearing, moment transmission components such as belt, pulley, gear assembly, etc., providing the transmission of the motor movement to the shaft-flange-drum group. The drum (3) rotates around its axis of symmetry, by means of these moment transmission components in case the motor is below the tub (2), and by means of the rotative movement transmitted directly to the shaft, in case it is above the roller bearing. On the inner surface of the drum (3) wherein the laundry is loaded, are a plurality of baffles and on its outer surface are a plurality of small holes/piercings. In some machines, on the front and/or rear surfaces there are balancing components with moving small masses therein.

The moving tub assembly making vibratory movements in the machine, is connected to the cabinet (1) by means of a suspension mechanism consisting of such components as spring (4) and damper (5). In the suspension mechanisms formed by the conventional technique, one or more spring (s) [4] and/or damper (s) [5]; and/or spring-damper which functions as spring and damper, are used. By means of elastic bellow, placed on the body (1) between the loading door and the front surface of the tub, water is retained in the tub (2), prevented to leak out of the tub (2) during the operation of the machine.

Washing is a process provided by the rotational movements of the drum (3) to left or to right, and by its stopping and waiting for a certain period without rotating, after controlling such parameters as direction, speed, time period, angle of rotation; amount, type, temperature of the washing water; type, amount of chemical cleaning agents are controlled. During this process, the rotative speed of the drum (3) is such that it will not allow the laundry within the drum are spinned on the wall of the drum due to the centrifugal force and rotate together with the drum. The baffles on the inner surfaces of the drum (3) provide the movement, raising and dropping and tumbling of the laundry inside the drum during washing and can also serve to circulate the water within the drum.

During the rinsing cycle, following the washing cycle, generally the drum (3) will rotate together with the laundry it contains, under the effect of centrifugal force: however it is rotated at low speeds so that an excessive imbalance will not be created because of the high amount of water. During this process an important portion of water remained in the laundry is discharged into the tub (2) under the effect of the centrifugal forces created by the rotation of the drum (3), out of the drum holes. Controls are made in order to determine the rotational speed of the drum (3) wherein a high speed spinning will be realized.

After the completion of washing and rinsing phases, during the spinning cycle some more of the remaining water in the drum is discharged into the tub (2) through the drum (3) holes, due to the high centrifugal forces created by the high speed rotation of the drum. Then water accumulated in the tub (2) is evacuated from the machine by means of a pump and the water discharge hose.

In the patent application No. EP 0 655 111 system consisting of metal cables with elastic, anti-impact and anti-vibration properties developed for supporting a rotary unit within a fixed frame, is explained. However, this system is completely different from the invention disclosed in this application in such points as its being metallic, its being connected to the tub and body at a single point and its basically functioning as a spring.

TECHNICAL PROBLEMS AIMED TO BE SOLVED BY THE INVENTION

The tub assembly including the drum (3) makes vibratory movements in the cabinet (1) in the washing cycle during the rotation of the drum, due to the immersion of the laundry into the washing water and taking it out and to the dropping of the laundry from certain heights within the drum i.e tumbling of the laundry: and in rinsing and spinning cycles, the non-uniform distribution of the laundry taking lumpy forms within the drum (3).

In the known suspension mechanisms; the resistance parameters of the springs (4) and damping parameters of the dampers (5), taken into consideration together with weight of the moving tub assembly and the resistance and/or damping parameters of such components as the bellows placed between the tub assembly (2) and the cabinet (1), or water hoses etc., should be "rigid" enough so that the tub assembly can easily make vibratory movements without hitting the fixed components, but it should also be 'soft' enough to transmit the forces created due to vibration without causing the cabinet (1) to move on the floor. In other words, a "too rigid" suspension mechanism decreases the vibration of the tub assembly but increases the possibility of the cabinet (1) moving on the floor whereas a too 'soft' suspension mechanism reduces the possibility of its moving oil the floor but causes an increase in the vibratory movements of the tub assembly and subsequently the possibility of hitting the fixed components.

Another parameter defining the resistance/damping properties of the suspension mechanism and preventing it from being "too soft" is the necessity of preventing the tub assembly from sinking too much into the cabinet (1) and consequently preventing the centers of the drum (3) rotational axis and the laundry loading gate on top of the cabinet (1) from being differentiated. In such a case, the rubber bellow-like gasket placed between the laundry loading gate and the drum (3) will be worn out and/or will draw the resistance/damping parameters of the suspension mechanism to unwanted levels due to its excessive deformation.

The objective of the present invention is to provide the suspension of the tub assembly in such a manner that it can vibrate freely in the body, by using the elastic bands (6) instead of the suspension mechanism components such as spring (4), damper (5) etc. that arc used in the conventional systems or together with them. The required resistance and damping parameters are obtained by sizing the bands (6) appropriately, by the elasticity of the bands and (or by their reciprocal movements with friction on the tub (2) as shown in FIG. 6, consequently the vibrations of the tub assembly are suppressed and transmitted to the fixed exterior cabinet (1) of the machine so that they would not disturb the user.

Another objective of the present invention is to make the suspension mechanism "softer" than the stiffness degree implemented by the existing technique, in other words, to reduce the resistance/damping parameters of the suspension mechanism, with or without the suspension mechanism components such as spring (4), damper (5) etc. that are used in the conventional systems, so that the bellow component located between the loading door and the drum (3) will not be worn off and it will not draw the resistance/damping parameters of the suspension mechanism to unwanted levels due to its excessive deformation. In this way the impact of the tub assembly to the fixed components will be prevented and it will be possible to reduce the movement of the cabinet (1) on the floor so that the sinking of the tub assembly into the cabinet (1) due to the weight of the washing water taken into the tub (2) during the operation of the washing machine and consequently the differentiation between the centers of the drum (3) rotational axis and the loading door will the prevented.

Yet another objective of the present invention is the use of elastic bands (6) being the subject matter of the invention, in the place of such suspension mechanism components as spring (4), damper (5) etc. without using them. In this way, it will be possible to reduce the size of the space required between the structure body (1) and the tub assembly due to the geometrical structures of the known suspension mechanism components; consequently, to reduce the total volume and weight of the machine; or with the same body (1) dimensions, to provide the utilisation of the gained extra volume for other purposes; to carry the production and installation procedures of the suspension mechanism in a more economical way than the conventional technique from the standpoint of cost and time.

BRIEF EXPLANATION OF THE DRAWINGS

FIGS. 8*a*–8*d* show bands formed of cables, thin wires, in cylindrical form, and in braided form, respectively.

DESCRIPTION OF THE INVENTION

Figure 1A:
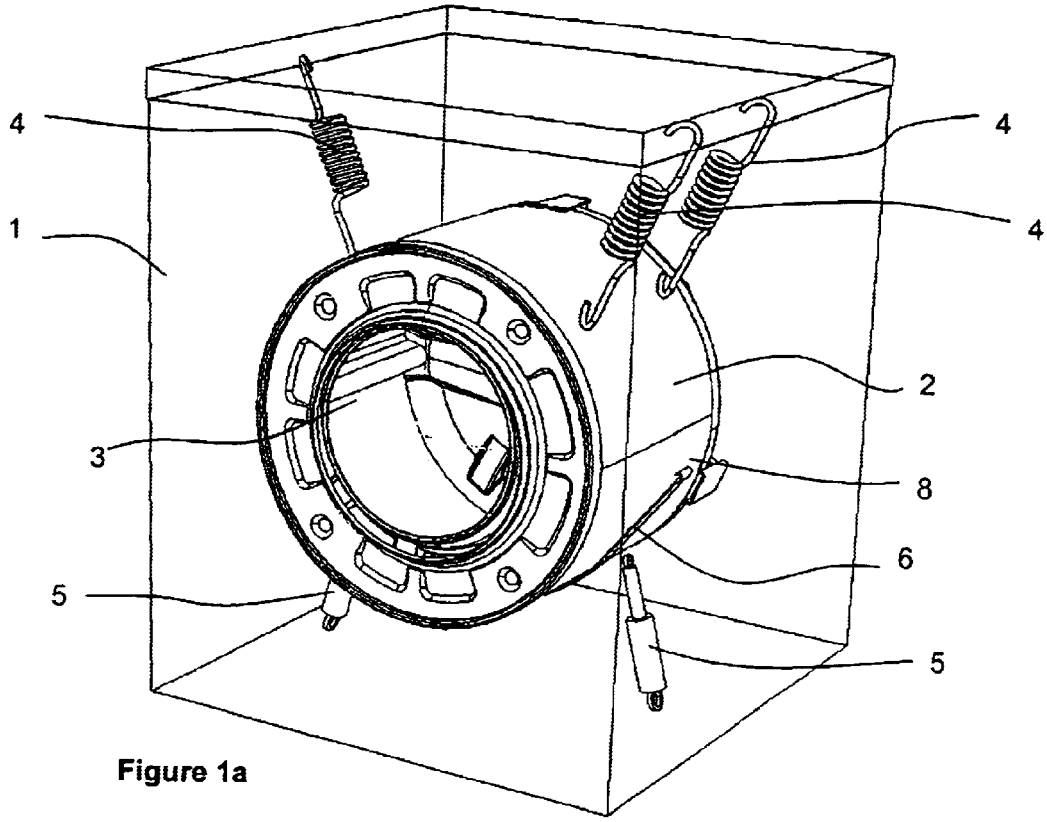
FIG. 1*a*, is the perspective view showing the use of one band (6) lying on a plane to traverse the geometrical axis of the tub (2) (and the rotational axis of the drum (3))

The suspension mechanism according to the invention, consists of the connection of the moving tub assembly within the machine to the cabinet (1) by using one or more elastic bands (s) (6) made of preferably but not limited to, elastomer based elastic material, lying on one or more plane (s) traversing and/or crossing longitudinally the geometrical axis of the tub (2) (and the rotational axis of tile drum (3)) or, are perpendicular and/or parallel with regard to the floor.

In the suspension mechanism of the invention;

The bands (6) may be used in the place of the suspension mechanism components of the conventional technique, such as spring (4), damper (5), etc. or together with them;

Some or all of the bands can be connected rigidly so that they support the weight of the tub assembly or they can be connected loosely so that some or all of them will start functioning only after some movement of the tub assembly;

Bands can be of any cross section, preferably with a rectangular cross section and are dimensioned to provide the required resistance and damping properties;

The bands can have a continuous cross section or have discontinuities with holes of various sizes;

Two or more of the bands (6) on the same plane are connected in parallel and/or at a small angle with regard to each other.

Figure 6A:
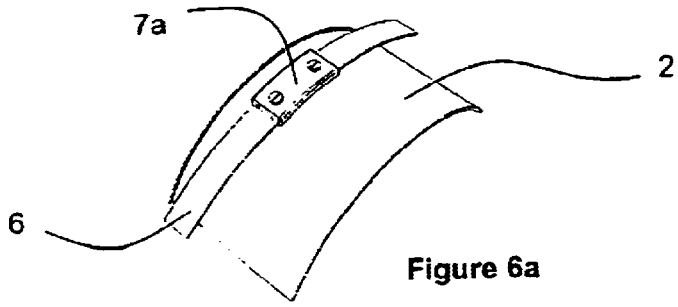
FIG. 6*a*, shows the connection of the bands (6) to the tub (2) in a rigid way, in a perspective view.
Figure 6B:
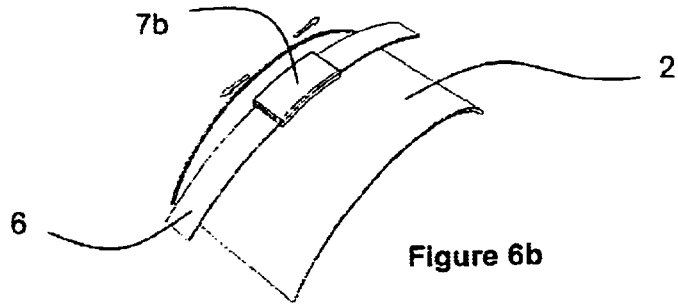
FIG. 6*b*, shows the connection of the bands (6) to the tub (2) in a rigid way, movably on the tub, in a perspective view.
Figure 6C:
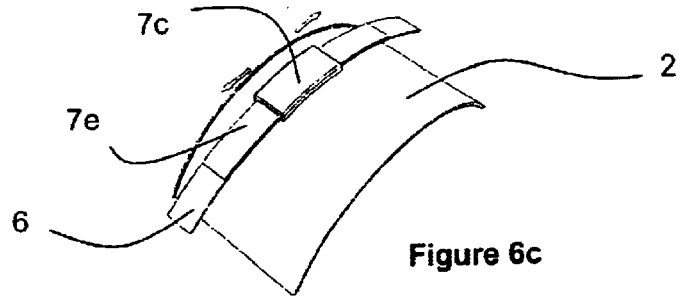
FIG. 6*c*, show the connection of a separate part incorporated to the center of the bands (6) so that it can move over the tub (2), in a perspective view.
Figure 6D:
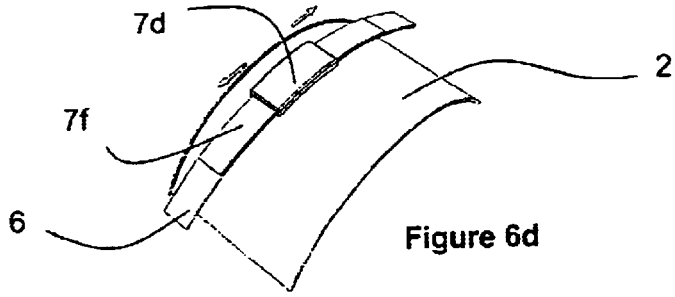
FIG. 6*d*, show the connection of a separate part incorporated to the center of the bands (6), on their upper and lower surfaces so that it can move over the tub (2), in a perspective view.
Figure 7A:
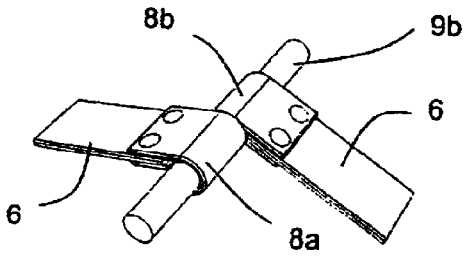
FIG. 7*a*, shows schematically the connection of the fastening parts (8*a*, 8*b*) joined to the ends of the bands (6) by attaching them to a long pin (9*b*) to which other bands can also be fastened in such a manner that they are mutually opposed and side by side, to the cabinet (1).
Figure 7B:
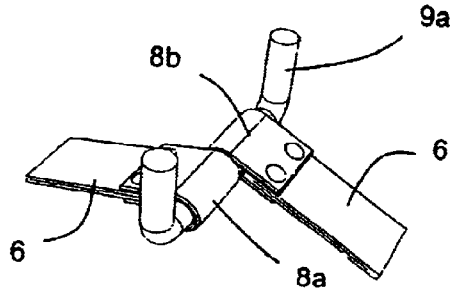
FIG. 7*b*, shows schematically the connection of the fastening parts (8*a*, 8*b*) joined to the ends of the bands (6) by attaching them to a pin (9*a*) slightly longer than the width of the bands on which only two bands are attached; in such a manner that they are mutually opposed and side to side to the cabinet (1)
Figure 7C:
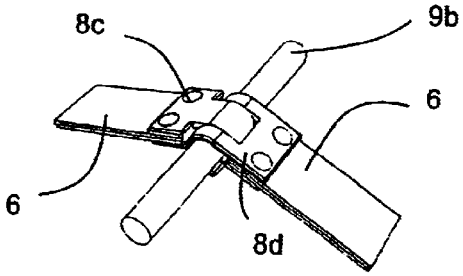
FIGS. 7*c* and 7*e*, shows schematically the connection of the fastening parts (8*c*, 8*d* and 8*e*, 8*f*) joined to the ends of the bands (6) so that they mutually interlock with each other, to the cabinet (1), by attaching them to a long pin (9*b*) to which other bands can also be fastened, in two embodiments of the invention.
Figure 7D:
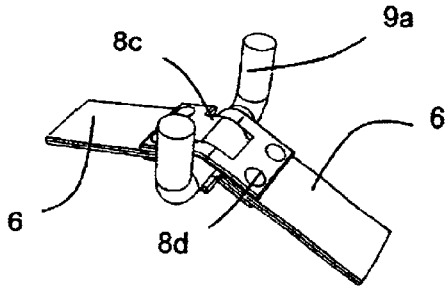
FIGS. 7*d* and 7*f*, shows schematically the connection of the fastening parts (8*c*, 8*d* and 8*e*, 8*f*) joined to the ends of the bands (6) so that they mutually interlock with each other, to the cabinet (1), by attaching them to a pin (9*a*) that is slightly longer than the width of the bands on which only two bands are attached, in two embodiments of invention.
Figure 7E:
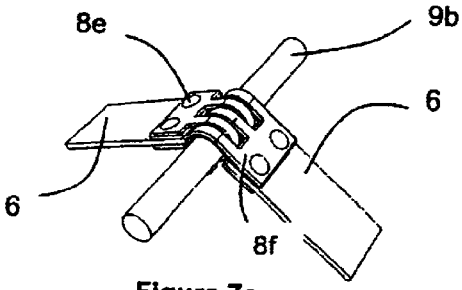
Figure 7F:
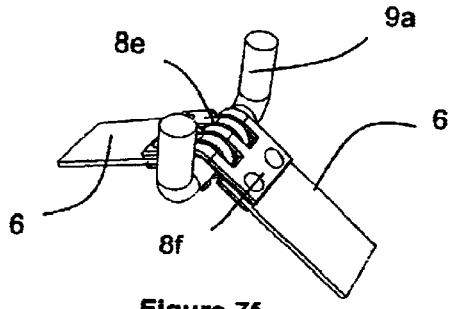

The connections (7) of the bands (6) to the tub (2) can be realised on the tub (2) peripheral iron sheet and/or front and rear iron sheets, at one or more points; in such a manner that:

one or more bands (s) are connected to the tub (2) rigidly by using a complementary piece (7*a*) (FIG. 6*a*), and/or by using a complementary piece (7*b*) to allow one or more bands (s) to make reciprocal movements on the tub (FIG. 6*b*) and/or by using a complementary piece (7*c*) to allow one or more band (s) joined by a different piece (7*e*), to make reciprocal movements on the tub (2) (FIG. 6*c*), and/or by using a complementary piece (7*d*) to allow one or more pieces (s) (7*f*) fastened to the lower and/or upper surfaces of one or more bands (FIG. 6*d*).

Both ends (8) of the bands (6) are formed by various production techniques to make their connection to the cabinet (1) possible or are fixed to the intermediary pieces (8*a*, 8*b*, 8*c*, 8*d*, 8*e*, 8*f*) which are formed for this purpose.

These intermediary pieces, as shown in FIG. 7, form a set when they are attached on a pin (9) in an opposing position, in such a manner that they are side by side (8*a*, 8*b*) or that they interlock with each other (8*c*, 8*d*, or 8*e*, 8*f*). For the fixation of these bands (6) onto the cabinet (1), the cabinet is provided with some components with which one or more band end (s) will be engaged. These components (9) shown in FIG. 7 can be in the form of:

pin-like components slightly wider than the width of the bands (6), on which each band end (6), is attached separately; or pin-like components (9*a*) slightly wider than the width of the bands (6), on which mutually opposed two band (6) ends are attached side-by-side or interlocking with each other; or pins (9*b*) extending from the front to the rear side on which one or mutually opposed two band (6) ends at different planes (e.g. at two different planes in the front and at the back of the tub (2)) are attached side-by-side or interlocking with each other.

Figure 1B:
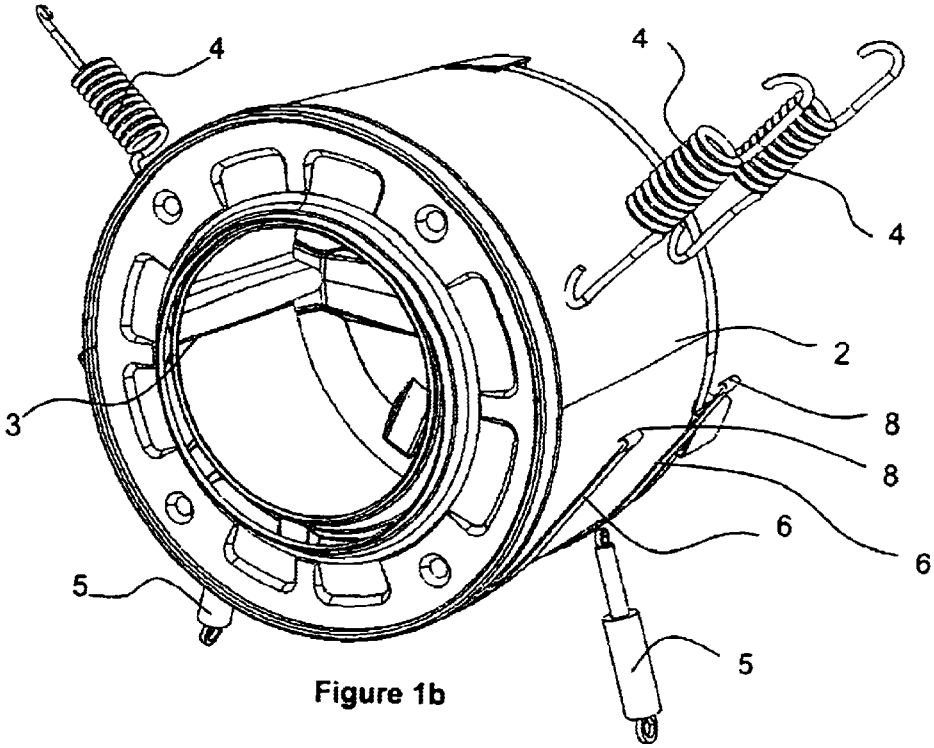
FIG. 1*b*, is the perspective view showing the use of two bands (6) each one lying on two separate planes traversing the geometrical axis of the tub (2) (and the rotational axis of the drum (3)).
Figure 2A:
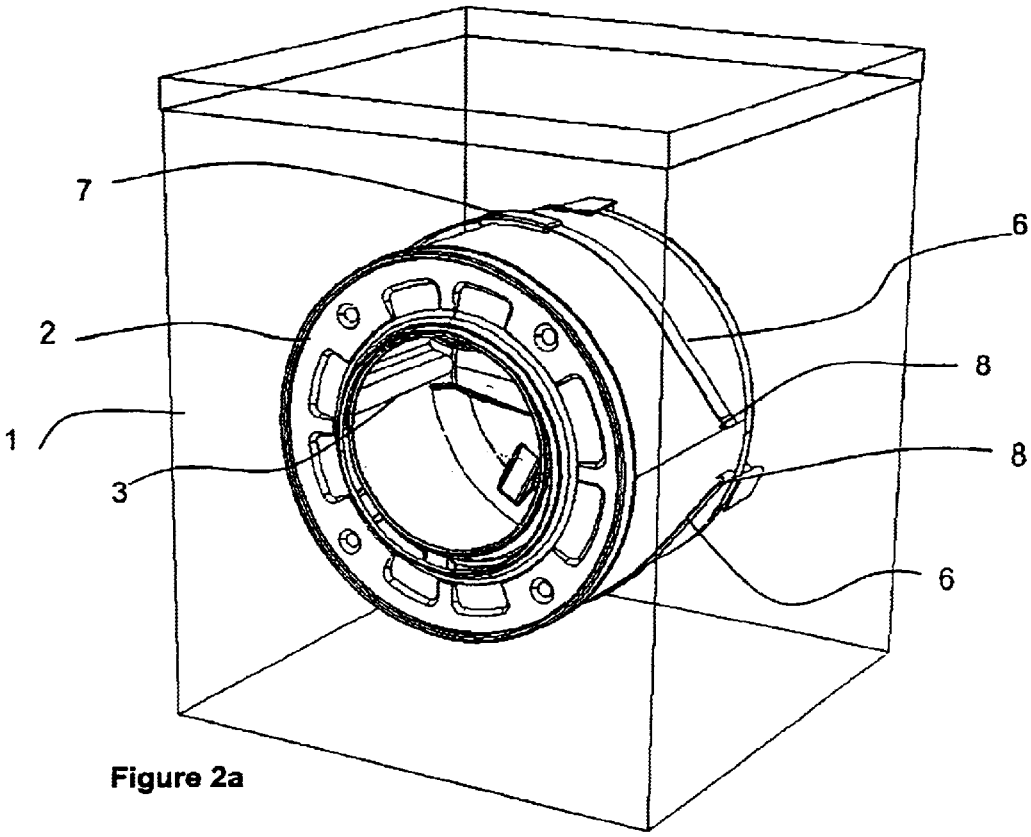
FIG. 2*a*, is the perspective view showing the use of two bands (6) lying on a plane traversing the geometrical axis of the tub (2) (and the rotational axis of the drum (3))
Figure 2B:
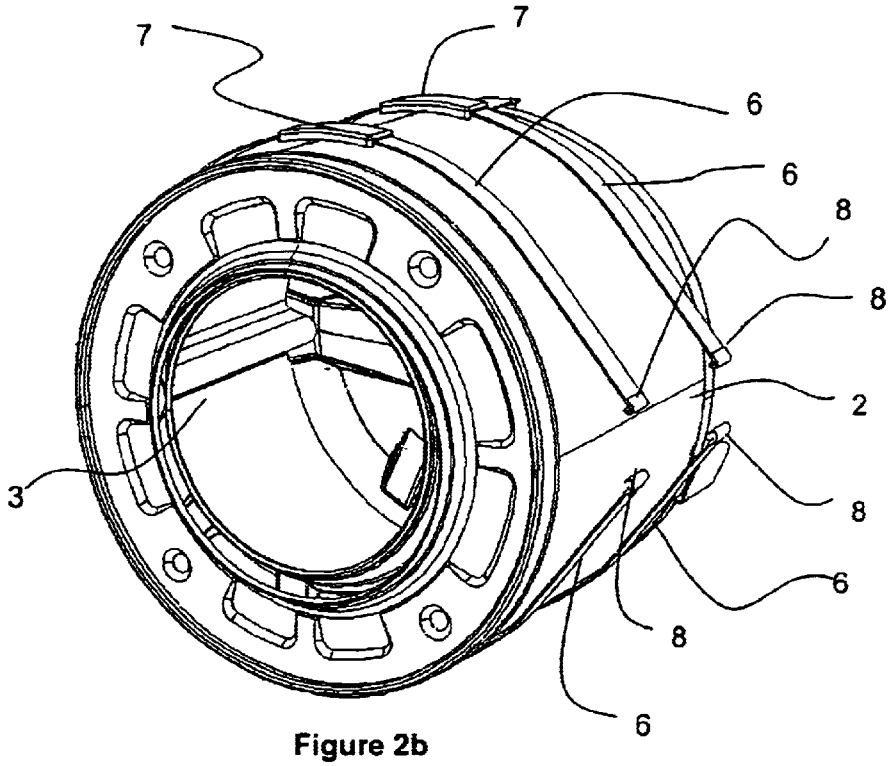
FIG. 2*b*, is the perspective view showing the use of four bands (6) each pair lying on two separate planes traversing the geometrical axis of the tub (2) (and the rotational axis of the drum (3))
Figure 3A:
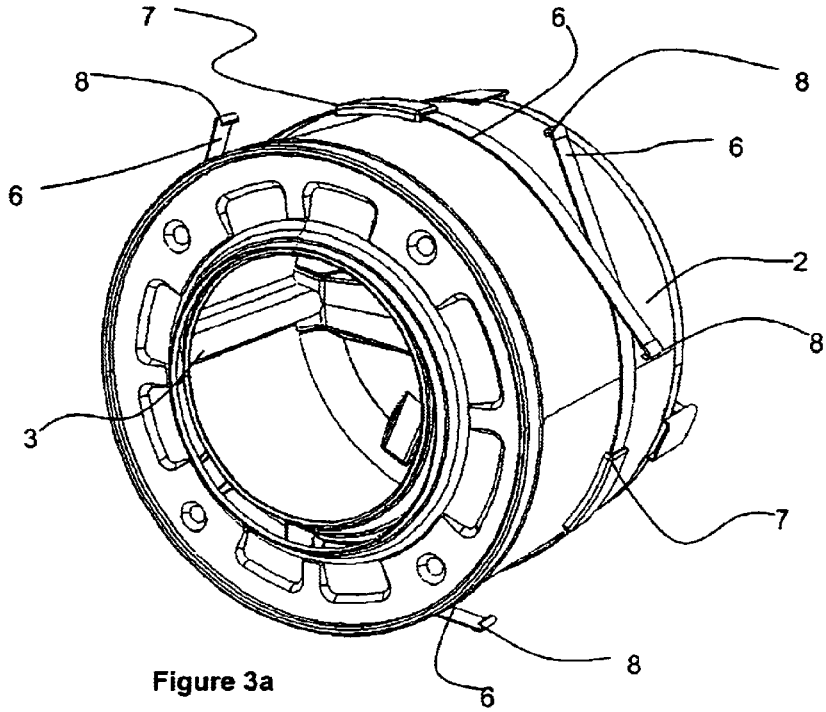
FIG. 3*a*, is the perspective view showing the use of three bands (6) lying on a plane traversing the geometrical axis of the tub (2) (and the rotational axis of the drum (3))
Figure 3B:
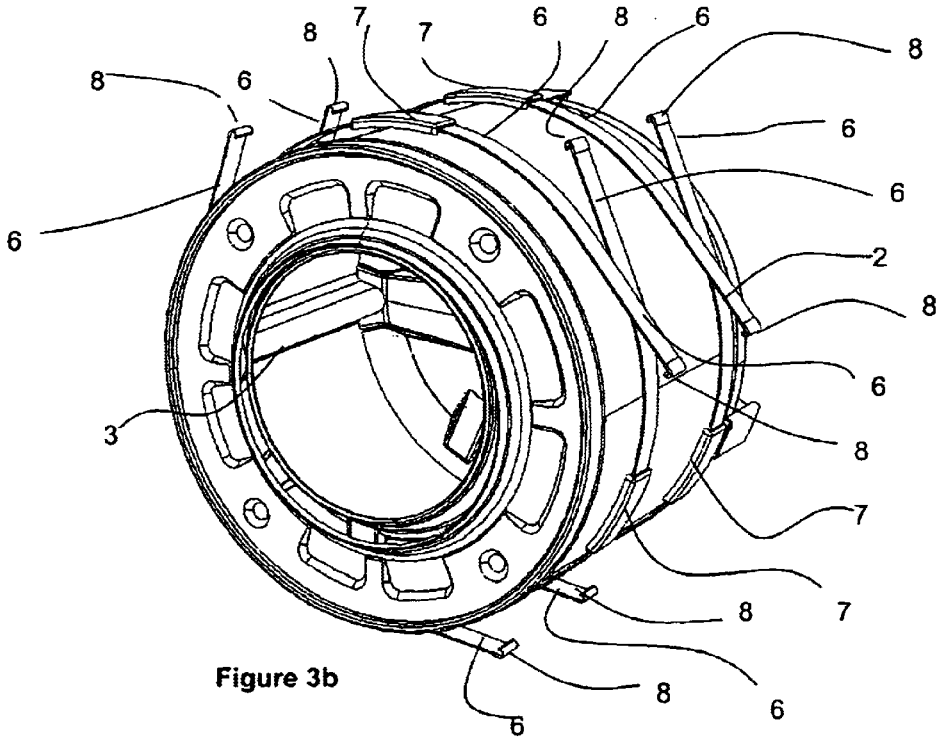
FIG. 3*b*, is the perspective view showing the use of six bands (6) three each lying on two separate planes traversing the geometrical axis of the tub (2) (and the rotational axis of the drum (3))
Figure 4A:
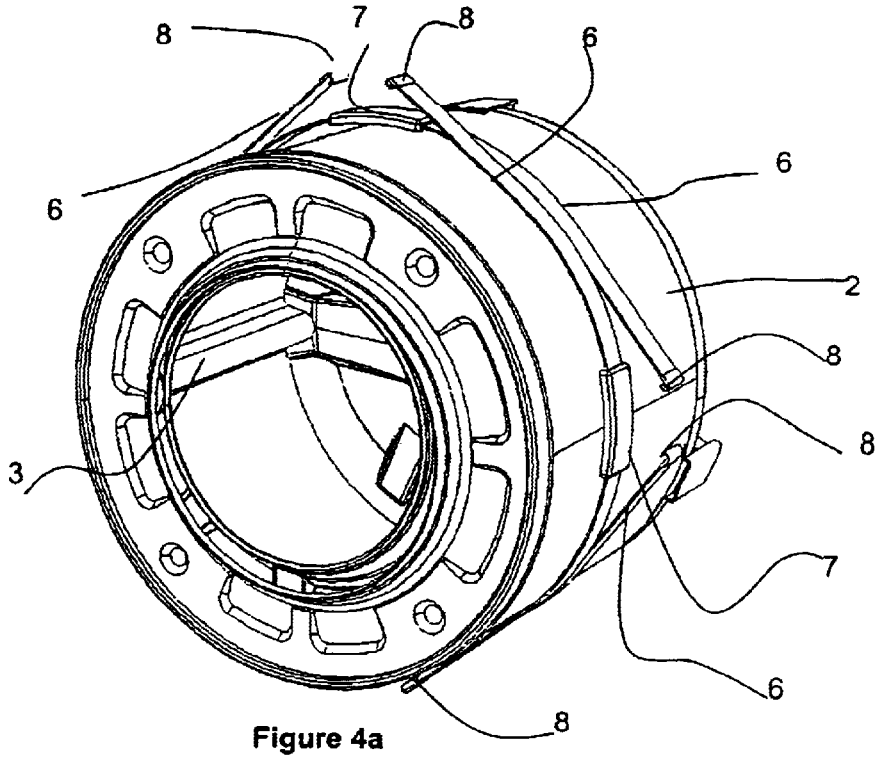
FIG. 4*a*, is the perspective view showing the use of four bands (6) lying on a plane traversing the geometrical axis of the tub (2) (and the rotational axis of the drum (3))
Figure 4B:
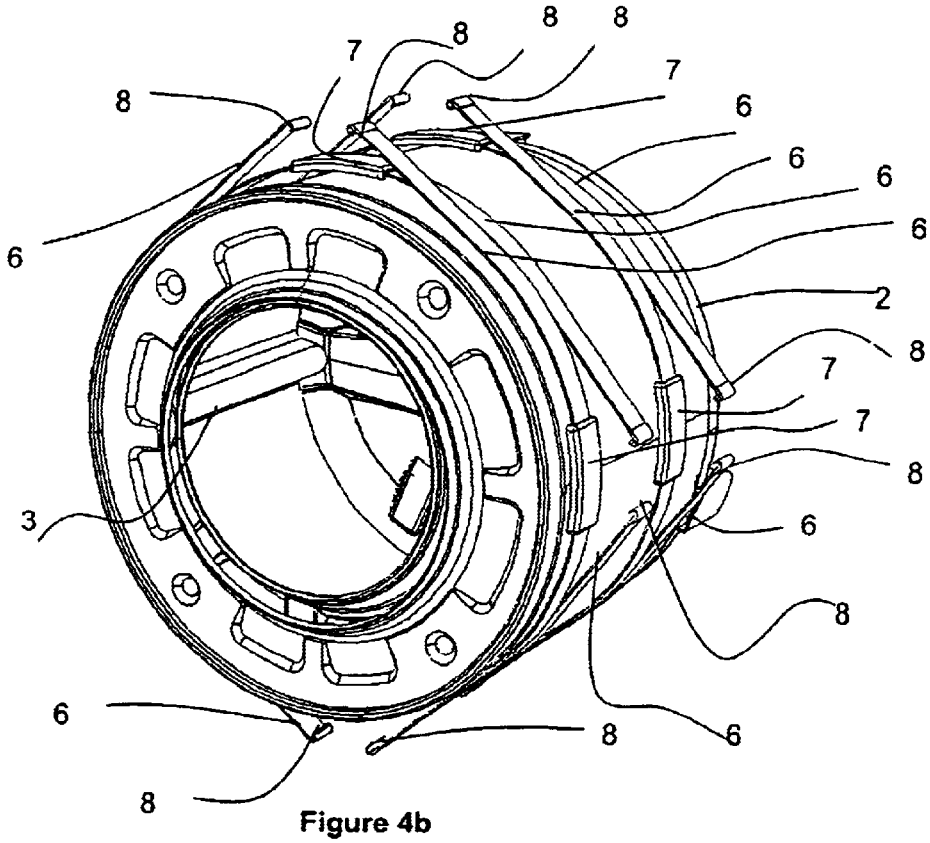
FIG. 4*b*, is the perspective view showing the use of eight bands (6) four each lying on two separate planes traversing the geometrical axis of the tub (2) (and the rotational axis of the drum (3))

For illustrative purposes:

FIGS. 1*a* and 1*b* show respectively the use of one band (6) each at one and two planes perspectively;

FIGS. 2*a* and 2*b* show respectively the use of two bands (6) each pair at one and two planes perspectively;

FIGS. 3*a* and 3*b* show respectively the use of three bands (6) each three at one and two planes perspectively;

FIGS. 4*a* and 4*b* show respectively the use of four bands (6) each four at one and two planes perspectively;

In these examples, the tub assembly has a cylindrical structure that is parallel to the ground and the connection plane of the bands (6) traverses the tub (2) geometrical axis (and drum (3) rotational axis). In case the tub assembly is positioned as inclined at an angle smaller than 45° to the ground, the connection planes of the bands may also be inclined at a certain angle towards the ground, traversing the tub (2) geometrical axis (and drum (3) rotational axis) the same way, or can be perpendicular to the ground and consequently traversing the tub (2) geometrical axis (and drum (3) rotational axis) at a certain angle.

Figure 1C:
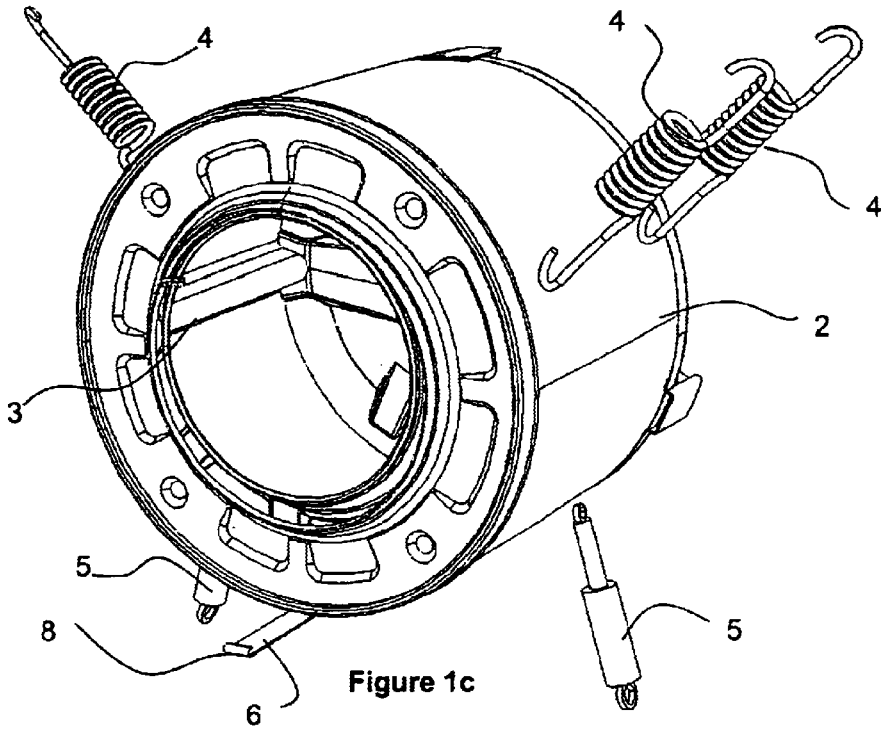
FIG. 1*c*, is the perspective view showing the use of one band (6) lying on a plane crossing the geometrical axis of the tub (2) (and the rotational axis of the drum (3)) longitudinally.
Figure 1D:
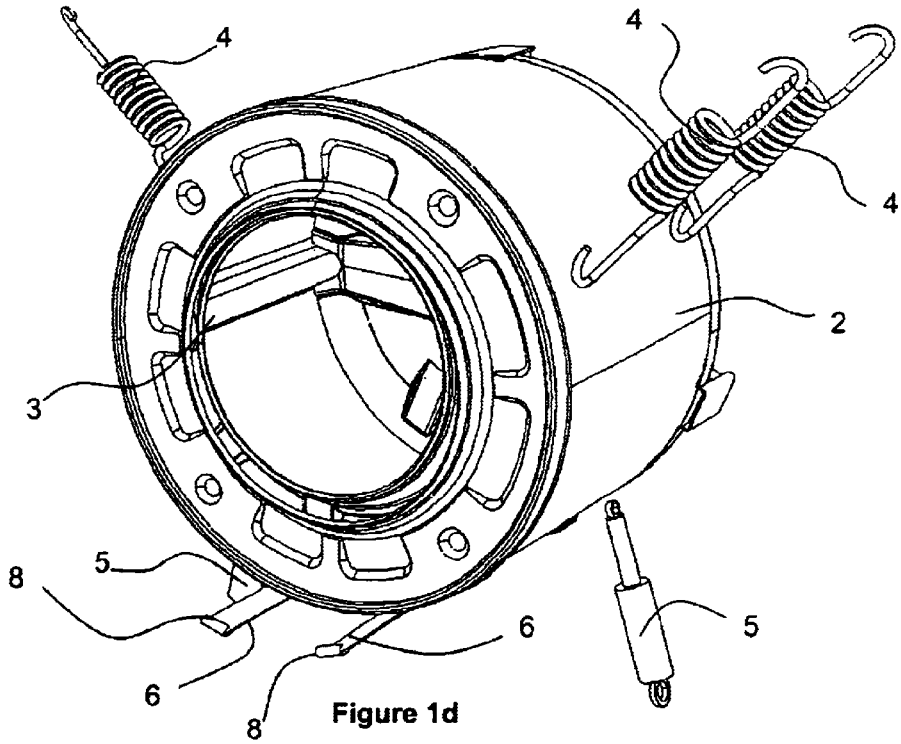
FIG. 1*d*, is the perspective view showing the use of two bands (6) each lying on two separate planes crossing the geometrical axis of the tub (2) (and the rotational axis of the drum (3)) longitudinally.
Figure 2C:
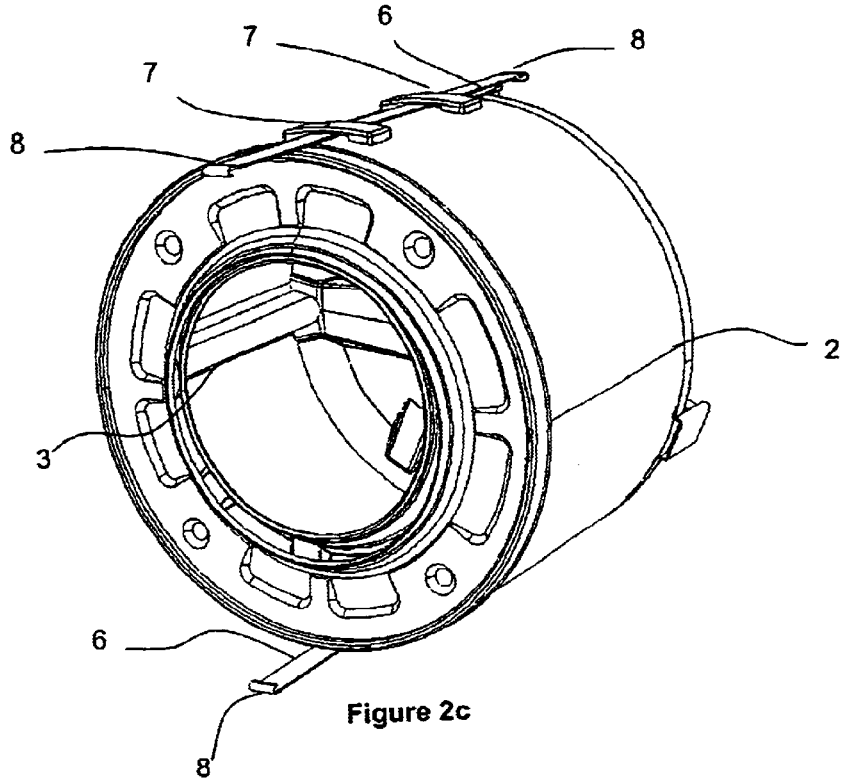
FIG. 2*c*, is the perspective view showing the use of two bands (6) lying on one plane crossing the geometrical axis of the tub (2) (and the rotational axis of the drum (3)) longitudinally.
Figure 2D:
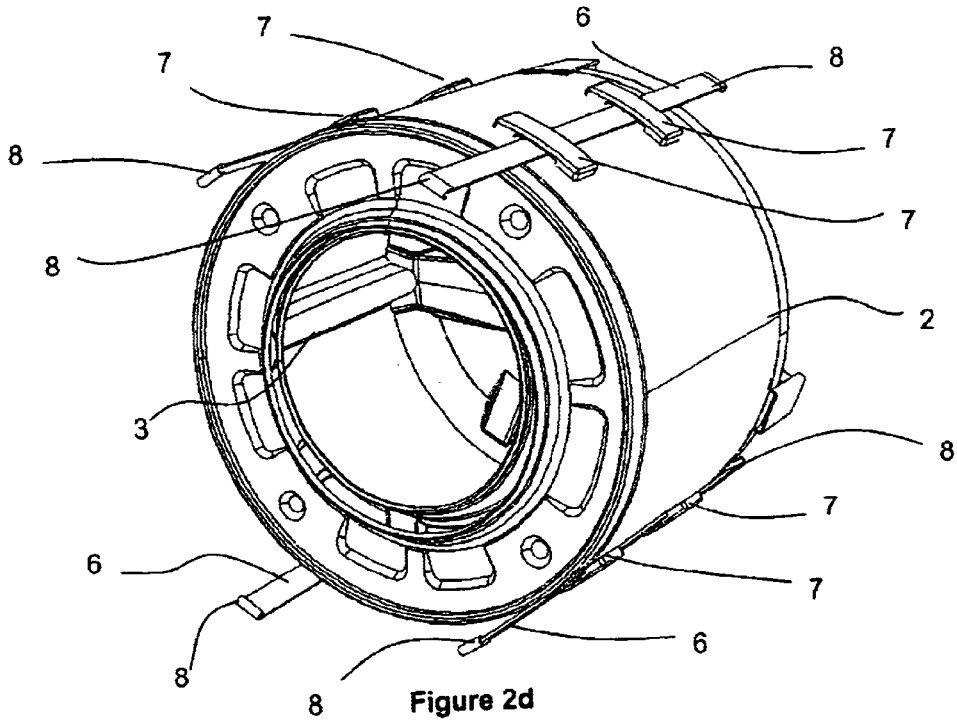
FIG. 2*d*, is the perspective view showing the use of four bands (6) each pair lying on two separate planes crossing the geomiietrical axis of the tub (2) (and the rotational axis of the drum (3)) longitudinally.

FIGS. 1*c* and 1*d* show respectively the use of one band (10) each, crossing the tub (2) geometrical axis (and drum (3) rotational axis) longitudinally at one and two planes. whereas FIGS. 2*c* and 2*d* show respectively the use of two bands (6) each, crossing the tub (2) geometrical axis (and drum (3) rotational axis) at one and two planes.

Figure 5A:
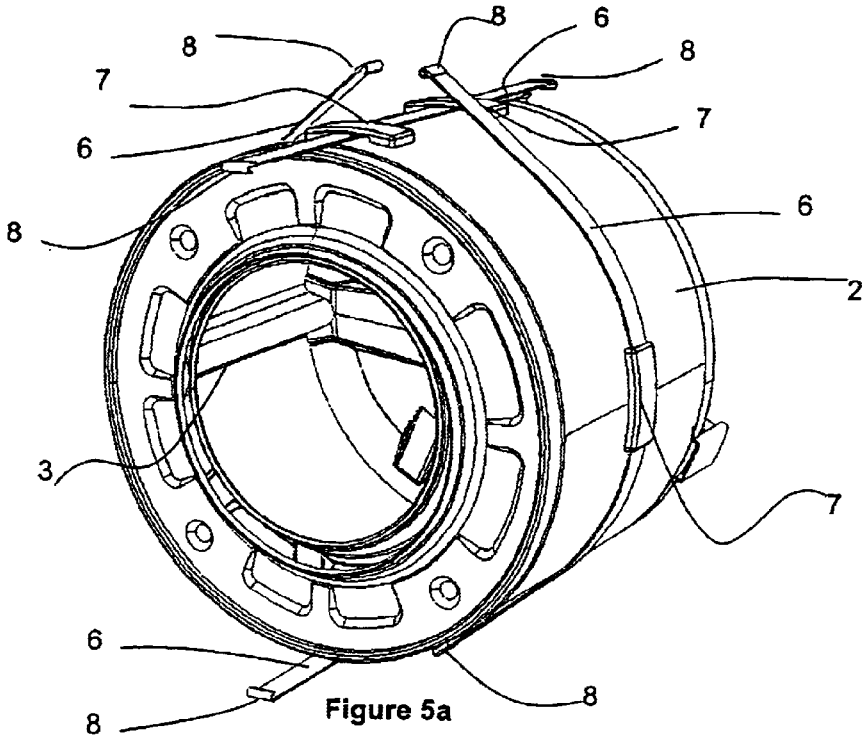
FIG. 5*a*, is the perspective view showing the use of two bands (6) lying on a plane traversing the geometrical axis of the tub (2) (and the rotational axis of the drum (3) and two bands (6) lying on a plane crossing the geometrical axis of the tub (2) (and the rotational axis of the drum (3)) longitudinally.
Figure 5B:
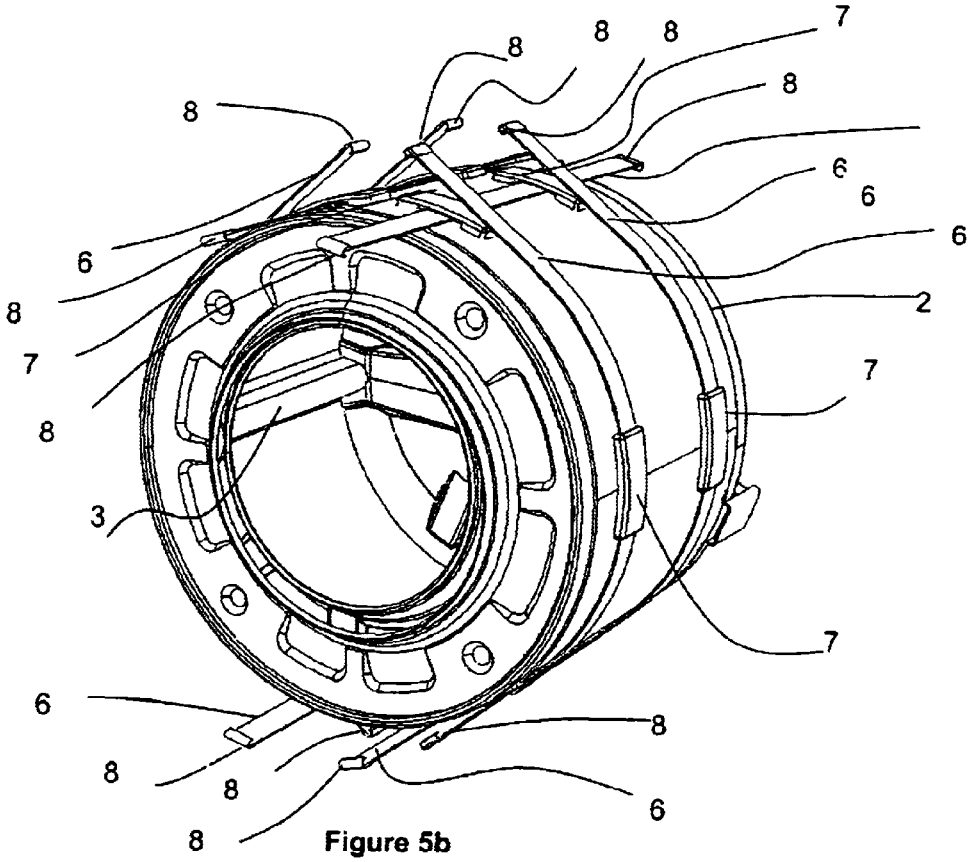
FIG. 5*b*, is the perspective view showing the use of four bands (6) two each lying on two separate planes traversing the geometrical axis of the tub (2) (and the rotational axis of the drum (3) and four bands (6) two each lying on two separate planes crossing the geometrical axis of the tub (2) (and the rotational axis of the drum (3)) longitudinally.

Each connection detail shown as examples in FIGS. 1,2,3 and 4, can be used separately or in combination with each other. FIG. 5*a*, presented as an example of referred combination forms, is the perspective view showing the use of two bands (6) on a plane traversing the tub (2) geometrical axis (and drum (3) rotational axis) and the use of two bands (6) on a plane crossing the tub (2) geometrical axis (and drum (3) rotational axis) longitudinally; whereas FIG. 5*b* is the perspective view of the use of two bands each (6) on two separate planes traversing the tub (2) geometrical axis (and drum (3) rotational axis) and the use of two bands (6) each lying on two separate planes crossing the geometrical axis of the tub (2) (and the rotational axis of the drum (3) longitudinally.

In a specific embodiment shown in FIGS. 1*a* and 1*b*, wherein the bands (6) of the invention are used in addition to (as supplementary) such components as spring (4), damper (5), etc., one or more elastic bands (6) with following properties are used:

Connected to the cabinet (1) from bath ends and to the tub (2) from at least one point at the intermediary region, so that they extend below the tub (2) inside the cabinet (1)

When there is no water in the tub (2), loose enough not to have any resistance/damping effect on the tub in the position where the drum (3) axis and the front door axis coincide with each other;

When the tub (2) is filled with water, the tub assembly sinks down and is supported by these bands which apply a certain force to avoid the tub assembly from further sinking down, These bands loosen again after the water in the tub (2) is discharged and the tub assembly rises up again and thereafter the bands do not apply any force on the tub assembly during rinsing and spinning phases.

It will be appreciated that the bands may also be formed of cables 10 or thin wires 11. Additionally, the bands may be in cylindrical form as illustrated in FIG. 8*c* at 12 or it may be in braided form as illustrated at 13 in FIG. 8*d*.

MODE OF APPLYING THE INVENTION TO INDUSTRY

Due to the present invention, it has been possible to reduce the total volume occupied by the washing machine and therefore to reduce its weight without changing the capacity of washing. Thus;

transportation of the machine from the production plant to the sales point and from the sales point to the user s property becomes more economical and easier;

accomodation and/or displacing of the machine in such volumes as kitchen, bathroom etc. of the user is easier.

In case the machine cabinet (1) according to the invention is manufactured with the same dimensions as the conventional machines, it is also possible to place the laundry loading door higher and consequently in a more ergonomical way than those in the conventional machines and to use the additional volume provided by this way for other purposes.

What is claimed is:

1. A washing machine with a horizontal axis comprising:

a cabinet, a tub assembly mounted for vibratory movement in the cabinet, a drum mounted for rotational movement about an axis passing through the tub assembly and in which laundry to be washed is loaded;

said tub assembly being carried by a suspension mechanism including one or more bands, both ends of each of said one or more bands being connected to the cabinet;

said bands being connected to a peripheral iron sheet on at least one point thereof and forming part of the tub assembly, said connection enabling the one or more bands for reciprocal movements on the tub assembly.

2. A washing machine according to claim 1 wherein some of said one or more bands are elastomer-based elastic bands.

3. A washing machine according to claim 1 wherein some of said one or more bands comprise metallic leaf springs.

4. A washing machine according to claim 1 wherein some of said one or more bands comprise cables.

5. A washing machine according to claim 1 wherein some of said one or more bands comprise thin wires.

6. A washing machine according to claim 1 wherein some of said one or more bands are in the form of thin, flat plates.

7. A washing machine according to claim 1 wherein some of said one or more bands are in a cylindrical form.

8. A washing machine according to claim 1 wherein some of said one or more bands are in a braided form.

9. A washing machine according to claim 1 wherein some of said one or more bands have a continuous cross-section without any discontinuities.

10. A washing machine according to claim 1 wherein some of said one or more bands have discontinuities.

11. A washing machine according to claim 1 including a separate friction component intermediate the ends of said one or more bands, enabling said one or more bands to make reciprocal movements on the tub assembly.

12. A washing machine according to claim 1 wherein said separate friction components are joined to lower or upper surfaces of the bands, enabling said one or more bands to make reciprocal movements on said tub assembly.

13. A washing machine according to claim 1 wherein some of said one or more bands lie in one or more planes extending normal to and passing through a geometrical axis of the tub assembly and a rotational axis of said drum.

14. A washing machine according to claim 1 wherein some of said one or more bands extend longitudinally and lie in one or more planes extending parallel to a geometrical axis of the tub assembly and an axis of rotation of said drum.

15. A washing machine according to claim 1 wherein some of said one or more bands lie in one or more planes extending normal to and passing through a geometrical axis of the tub assembly and a rotational axis of the drum, some of said one or more bands extend longitudinally and lie in one or more planes extending parallel to a geometrical axis of the tub assembly and a rotational axis of the drum.

16. A washing machine according to claim 1 wherein fastening elements at ends of the bands are connected to the cabinet by a set of elements disposed side-by-side when mutually engaged.

17. A washing machine according to claim 16 including a pin on the cabinet extending slightly longer than a width of the bands on which each band end is attached separately for fixation of some of said one or more bands to the cabinet.

18. A washing machine according to claim 16 including pins on the cabinet that are slightly longer than a width of the bands, two opposing band ends being attached to said pins so that they are side-by-side for fixation of some or all of said one or more bands.

19. A washing machine according to claim 16 including pins on the cabinet extending slightly longer than a width of the bands, on which two opposing band ends are attached concentrically for fixation of some or all of said one or more bands to the cabinet.

20. A washing machine according to claim 16 including pins extending from the front to the back of the cabinet sufficiently long for attachment of other bands on said pins, two opposing band ends being attached concentrically on said pins for the fixation of some or all of said one more bands.

21. A washing machine according to claim 16 including connection rods extending from front to back of the cabinet that are sufficiently long for attachment of other bands on said rods, two opposing band ends being attached concentrically on said rods for fixation of some or all of said one or more bands.

22. A washing machine according to claim 1 including fastening elements at ends of the bands connected to the cabinet by a set of elements mutually interlocked with each other.

23. A washing machine according to claim 1 wherein some or all of said one or more bands are connected loosely between the tub assembly and the cabinet so that the bands apply a force on the tub assembly only subsequent to a certain movement of the tub assembly.

* * * * *